US008082970B2

(12) United States Patent
Gower

(10) Patent No.: US 8,082,970 B2
(45) Date of Patent: Dec. 27, 2011

(54) INFLATABLE BARRIER

(76) Inventor: Ted Gower, N. Palm Beach, FL (US)

( * ) Notice: Subject to any disclaimer, the term of this patent is extended or adjusted under 35 U.S.C. 154(b) by 948 days.

(21) Appl. No.: 11/131,875

(22) Filed: May 17, 2005

(65) Prior Publication Data

US 2006/0260226 A1 Nov. 23, 2006

(51) Int. Cl.
*E06B 9/06* (2006.01)
*E04B 1/342* (2006.01)

(52) U.S. Cl. ..... 160/120; 52/238; 52/222; 52/23; 52/202

(58) Field of Classification Search ..... 52/2.11–2.26, 52/167.1, 167.7, 167.2, 223.6, 23, 291, 222, 52/202, DIG. 11; 160/391, 232, 183, 352, 160/120, 229.1, 56, 56.1; 135/88.81, 88.14, 135/90, 913, 115, 119, 903; 16/378–379
See application file for complete search history.

(56) References Cited

U.S. PATENT DOCUMENTS 2,028,060 A * 1/1936 Gilbert ..... 47/32.5
2,341,023 A * 2/1944 Davis ..... 160/174 V
3,020,951 A * 2/1962 Graulich ..... 160/35
3,332,177 A * 7/1967 Sepp ..... 52/2.19
3,432,609 A * 3/1969 Brion, Jr. et. al. ..... 174/363
3,745,938 A * 7/1973 Hathaway et al. ..... 109/49.5
3,805,816 A * 4/1974 Nolte ..... 135/115
3,847,091 A * 11/1974 Holt ..... 410/119
3,862,876 A * 1/1975 Graves ..... 428/83
3,893,273 A * 7/1975 Sailor ..... 52/291
3,911,630 A * 10/1975 Nally ..... 52/2.12
3,918,512 A * 11/1975 Kuneman ..... 160/90
RE28,689 E * 1/1976 Turner ..... 264/46.6
3,949,527 A * 4/1976 Double et al. ..... 52/4
4,065,889 A * 1/1978 Fraioli ..... 52/2.23
4,156,330 A * 5/1979 Fraioli ..... 52/2.25
4,259,819 A * 4/1981 Wemyss ..... 52/222
4,283,888 A * 8/1981 Cros ..... 52/3
4,290,243 A * 9/1981 Mellin ..... 52/63
4,293,969 A * 10/1981 Frommelt ..... 14/71.1
4,333,271 A * 6/1982 DePaolo et al. ..... 49/464
4,397,122 A 8/1983 Cros
4,424,849 A * 1/1984 Robertson ..... 160/124
4,487,212 A * 12/1984 Moore ..... 135/90
4,590,714 A * 5/1986 Walker ..... 250/585
4,629,433 A * 12/1986 Magid ..... 441/40
4,649,681 A * 3/1987 Eisele ..... 52/202
4,848,386 A * 7/1989 Cooper ..... 135/90
4,858,395 A * 8/1989 McQuirk ..... 52/3
5,174,073 A * 12/1992 Sabo ..... 52/3
5,319,896 A * 6/1994 Winger ..... 52/23
5,347,768 A * 9/1994 Pineda ..... 52/23

(Continued)

*Primary Examiner* — Jeanette E. Chapman
(74) *Attorney, Agent, or Firm* — Cuenot, Forsythe & Kim, LLC

(57) ABSTRACT

A flexible hurricane shutter or barrier to protect buildings from over pressure has inflatable cushions held in place by a fabric material capable of withstanding winds in excess of 100 mph. The barrier can be stored on site in a rolled fashion. Retainers are mounted on a building to guide and secure the longitudinal edges of the fabric to permit ease of deployment. The retainers may be spaced apart over one side of a building and the barrier may be deployed over an entire surface of a multi-story building by raising and lowering the fabric. Inflatable cushions are held between the fabric and the building. The inflated cushions reinforce the material and distribute the force of impact throughout the surface of the cushions and act as spacers to both hold the fabric off the structure and focus the forces onto stranger portions of the structure.

13 Claims, 5 Drawing Sheets

U.S. PATENT DOCUMENTS 5,457,921 A * 10/1995 Kostrzecha ..... 52/202
5,472,037 A * 12/1995 Hoffman ..... 160/183
5,522,184 A * 6/1996 Oviedo-Reyes ..... 52/23
5,531,239 A * 7/1996 Hannah, Jr. ..... 135/88.1
5,570,545 A * 11/1996 Adams ..... 52/23
5,579,794 A * 12/1996 Sporta ..... 135/88.01
5,687,512 A * 11/1997 Spoozak et al. ..... 52/23
5,937,595 A * 8/1999 Miller ..... 52/202
6,128,862 A * 10/2000 Katz ..... 52/2.11
6,176,050 B1 1/2001 Gower
6,216,396 B1 * 4/2001 Katz ..... 52/2.11
6,325,085 B1 12/2001 Gower
6,381,910 B1 * 5/2002 Katz ..... 52/211
2005/0051544 A1 * 3/2005 Looker ..... 220/1.5

* cited by examiner

INFLATABLE BARRIER

RELATED APPLICATIONS

This application is related to U.S. patent application Ser. No. 10/446,006, filed May 22, 2003 and U.S. patent application Ser. No. 10/871,557, filed Jun. 18, 2004.

FIELD OF THE INVENTION

This invention relates to the protection of property against high winds and, in particular, to a flexible protective barrier device for securing property against the force of winds, rain and from impact of foreign objects carried by localized atmospheric over-pressure.

BACKGROUND OF THE INVENTION

As is known by one skilled in the art of protecting buildings and the like from damage caused by missile-like objects that are occasioned by the heavy winds of hurricanes, tornadoes, or explosive over-pressures, there are commercially available variations of hurricane protective devices, often called shutters, that fasten immediately over the frangible area to be protected. These devices are typically expensive to purchase cumbersome, made from stiff, heavy material such as steel and aircraft quality aluminum alloy or occasionally reinforced plastic. Many need to be manually connected and then removed and stored at each threat of inclement weather. Many require unsightly and difficult-to-mount reinforcing bars at multiple locations. Further, these known shutters are usually opaque, preventing light from entering a shuttered area and preventing an inhabitant from seeing out. Likewise, it is desirable that police be able to see into buildings to check for inhabitants and to prevent looting which can be a problem in such circumstances.

Missiles, even small not potentially damaging missiles, striking these heretofore known shutters create a loud, often frightening bang that is disturbing to inhabitants being protected. Standardized testing requiring these protective devices to meet certain standards of strength and integrity has been introduced for various utilizations and locales. In order to qualify for use where testing requirements apply, the strength and integrity characteristics of these protective devices must be predictable and must be sufficient to meet mandated standards.

Additionally, it is beneficial to qualify for these standards even in situations in which standards do not apply. As a result of these standards, many undesirable aspects of the previously known shutters have been acerbated. They have become more cumbersome, more bulky, heavier, more expensive, more difficult to store, and remain generally opaque and noisy when impacted.

To incorporate sufficient strength to meet said requirements, weight and bulk become a problem over six feet in span. The useable span (usually height) of the heretofore known shutters that meet said standards may be limited to eight feet or less. This makes protecting large windows, for example, or groupings of windows, with the heretofore known devices cumbersome, expensive and impractical. Devices that are intended to be deployed in a roll down manner either manually, automatically, or simply by motor drive, have been difficult to strengthen sufficiently to pass the test requirements and require unsightly reinforcing bars every few feet.

Prior to the introduction of said standards, an ordinary consumer had very little useful knowledge of the strength and integrity of said shutters. It is believed shutters of the pre-standard era were very weak such that all would fail the present standardized testing. As the hurricane conditions can be very violent and destructive, the standards are not intended to require strength and integrity sufficient to protect in all circumstances. The standards simply provide a benchmark as to strength and integrity. The strength and integrity of the shutters can now be measured by standardized tests.

There are many patents that teach the utilization of knitted or woven fabric such as netting, tarpaulins, drop cloths, blankets, sheets wrapping and the like for anchoring down recreational vehicles, nurseries, loose soil and the like. But none of these are intended for, nor are capable of withstanding the forces of the missile-like objects that are carried by the wind in hurricanes or explosive over-pressures.

Some protection devices have internal stiffness and rigidity that resists deflection, or bending. In rigid protection devices, it is stiffness that stops the missile short of the frangible surface being protected.

Other protection devices use fabric or netting material to cover a unit to be protected. Typically, the device completely covers the unit, and edges of the fabric are fastened to the ground. Examples of fabric employing devices are shown in the following patents: U.S. Pat. No. 3,862,876 issued to Graves, U.S. Pat. No. 4,283,888 and U.S. Pat. No. 4,397,122 issued to Cros, U.S. Pat. No. 4,858,395 issued to McQuirk, U.S. Pat. No. 3,949,527 issued to Double et al., U.S. Pat. No. 3,805,816 issued to Nolte, U.S. Pat. No. 5,522,184 issued to Oviedo-Reyes, U.S. Pat. No. 4,590,714 issued to Walker and U.S. Pat. No. 5,522,184 issued to Pineda. U.S. Pat. No. 5,522,184, for example, provides a netting that fits flush over the roof of a building and uses a complicated anchoring system to tie down the netting.

Typical of known flexible, fabric-employing protection devices is the characteristic of substantial rain and wind-permeability. For example, U.S. Pat. No. 5,579,794, issued to Sporta, discloses a wind-permeable perforate sheet that extends downwardly and outwardly from the top of the object to be protected at an acute angle so as to surround a substantial portion of each of the sides with an inclined wind-permeable planar surface.

U.S. Pat. No. 6,325,085 to Gower illustrates a barrier similar to the instant invention to be deployed inside a building or over individual windows. U.S. Pat. No. 6,176,050 to Gower teaches the use of the barrier material of this invention deployed over multi-story buildings. Both patents are incorporated herein by reference.

Thus, what is lacking in the art is an improved flexible protective barrier constructed from a mesh material with substantial rain and impact resistance that can be easily stored and deployed in combination with a flexible, inflatable, reinforcing cushion for protecting the frangible portion of a structure not only from objects carried by the wind but also from the force of the wind itself.

SUMMARY OF THE INVENTION

Therefore, it is an objective of this invention to teach the use of a flexible barrier synthetic textile that is able to satisfy stringent testing requirements. When used with a building, for example, the top edge of the fabric may be anchored to the eave of the roof and the bottom of the fabric may be attached to anchors imbedded in the foundation, ground or cement, so as to present a curtain adequately displaced from and in front of the structure of the building to be protected.

Knitted, woven or extruded material can be used if the material itself meets the criteria described later herein. The device provides a barrier that is substantially impermeable to rain and wind. Although air travels through the barrier, the barrier is approximately 95% closed, and the velocity of wind passing through the device is greatly reduced. For example, the velocity of a 100 mph wind is reduced by approximately 97% by passing through the wind abatement system of the present invention. The wind abatement system of the present invention substantially reduces the force of wind passing through the device and also provides a barrier against wind-borne missiles having diameters of approximately 3/16 inch in diameter or larger. Also, rain drops striking the barrier are reduced in velocity and dispersed into a mist which reduces the water damage to the structure.

Alternatively the material can be termed to be solid wherein the fabric is coated or the interstices of the fabric are filled by either close weaving, or use of a coating.

The inflatable cushion(s) between the fabric and the building provide displacement and pneumatic dissipation of the force of impact of debris on the fabric. This pneumatic plenum allows the flexible barrier system to be in direct contact with the structure being protected.

Another objective of this invention is to teach the use of very large areas with spans covering greater than 25 feet. Thus most window groupings, from a single window up to several stories of a building, could be readily protected. This invention is light in weight, easy to use, does not require reinforcing bars, can be constructed in varying degrees of transparency, can be weather tight, is economical, and is capable is dissipating far greater forces without damage than conventional stiff devices. Missiles striking this barrier make very little sound. Additionally, this invention is suitable to be configured with the necessary motor and mounting devices for automatic deployment.

Another objective of the invention is to permit the adaptation of the invention to meet a particular enclosure or object. For instance, the inflatable cushion(s) may be placed over a window, preferably a wind rated window, to provide the necessary spacing. Alternatively the inflatable cushion(s) may be placed over the mullions of a window thereby transferring wind loading directly to the inflatable cushion and thus to the structure of the mullion. Further, the inflatable cushion(s) may be placed along the edge of the window or on the structure abutting window. Similarly, the inflatable cushion(s) may be placed adjacent an object, such as a tiled wall, painting, statue, sculpture, or the like, to prevent wind, rain, and debris from impacting the object.

It is a further objective of this invention to teach a wind barrier that does not rely on rigidity but rather is very flexible, which gives several positive features including allowing for ease of storage as by deflating and rolling or folding. The fabric material in this barrier system is displaced from the structure being protected and this displacement is a function of the depth of the inflatable cushion. An impacting missile stretches the barrier until it decelerates to a stop or is deflected. The fabric material has a predetermined tensile strength and stretch that makes it suitable for this application. The known strength and stretch, together with the speed, weight and size of the impacting missile, all of which are given in test requirements, permit design calculation to ascertain barrier deflection at impact. The cushion is capable of a deflection, due to compression, commensurate with the stretch of the fabric to prevent rupture.

Thus greater energy from a missile can be safely dissipated than is possible with the prior art structures, and the energy which can be safely dissipated is calculable. In simple terms, the missile is slowed to a stop by elasticity as the barrier stretches and compression as the cushion deforms. The greater the impact, the greater the stretch and compression. Thus the building is not subjected to an abrupt harsh blow as the energy transfer is much gentler and less destructive that with the rigid devices.

It is yet another objective of this invention to teach the use of a screen-like fabric with interstices that permit the light to pass through and that is reasonably transparent, if desired. If transparency is not desirable, the fabric can be made sufficiently dense to minimize or eliminate the interstices. To assure a long life the material of the fabric preferably would be resistant to the ultra violet radiation, and to biological and chemical degradation such as are ordinarily found outdoors. This invention contemplates either coating the material or utilizing material with inherent resistance to withstand these elements. A synthetic material such as polypropylene has been found to be acceptable. Another example is a coated material of vinyl coated polyester. The coating may fill interstices to make a solid material. The fabrics may use natural or synthetic fibers and blends of fibers or blends of yarns, e.g., an open weave with steel reinforcing strands there through or Kevlar or other ballistic yarns. Materials intended to be used outdoors in trampolines, for example, are more likely candidates for use in this invention. Black colored polypropylene is most resistant to degradation from ultra violet radiation. Other colors and vinyl coated polyester are sufficiently resistant, particularity if the barrier is not intended to be stored in direct sunlight when not in use.

These same materials may be used to form the walls of the inflatable plenums or cushions. The cushions may be coated or laminated on the outside or inside surfaces to form air tight cells. The cushions may be made of extruded polymeric films. The desired amount of deformation, in the cushion, is a function of the elasticity of the material and the inflation pressure. The plenums may also be thin walled structures inserted into a sleeve of the barrier material which provides the requisite strength.

The preferred embodiment of the fabric allows air passage through it, albeit at substantially reduced rate. In one embodiment, upwind pressure of 1" of mercury, which roughly translates into a 100 mph wind, forces air through at 250 cfm or approximately 3 mph. The amount of air passage depends on the interstice size and percentage of openness. If a weather tight and transparent barrier is desired, the polypropylene material may be laminated with a flexible clear plastic skin.

It is of importance that the material affords sufficient impact protection to meet the regulatory agencies' requirements in order for this to be a viable alternative to other hurricane protective mechanisms. While stiff structures, such as panels of metal, are easily tested for impact requirement and have certain defined standards, fabrics on the other hand, are flexible and react differently from stiff structures. Hence the testing thereof is not easily quantified as the stiffer materials.

However, certain empirical relationships exist so that correlation can be made to compare the two mediums. Typically, the current impact test of certain locales requires a wood 2×4 stud be shot at the barrier exerting a total force of approximately 351 foot pounds, or 61.3 psi, over its frontal (impacting) surface. This impact and resultant force relate to the Mullen Burst test commonly used by manufacturers to measure the bursting strength of their fabrics. Thus the impact test heretofore used on rigid devices will work equally well on this flexible device.

The preferred embodiment of this invention would use a textile of the type typically used in trampolines which would burst at least 675 psi or a total of 2,531.25 pounds over the same 3.75 square inch frontal surface of the nominal 2×4 test missile wherein stretch characteristics of the material are known. The strength and stretch characteristics of the material are also known. The strength of this fabric is more than eleven (11) times the 351 foot pounds of strength required to withstand the above-described 2×4 missile test as presently required by said regulatory agencies. Stronger fabrics are available. Others are available in various strengths, colors and patterns.

The use of flexible fabric distanced out from the frangible area as a protective barrier allows extended deceleration. When the strength and stretch properties of the fabric are known and allowed for, as well as, these same properties in the inflated cushion, the extended deceleration becomes controlled. By mounting the protective barrier material some distance from the frangible surface, i.e., the thickness of the inflated cushion, a distance that is calculable, the missile can be decelerated to a stop prior to contacting the frangible surface. And the pounds per square inch of impact force are spread throughout the inner surface of the cushion. In other words, in any situation where the missile must stop prior to impacting the frangible surface being protected, it is desirable to decelerate the missile through an extended, controlled deceleration. This invention does precisely that. Since the use of a flexible material as a protective barrier affords an extended deceleration, very strong impacts can be withstood.

A further objective of this invention is to teach a barrier made from fabric to protect the frangible portions of a building and the like from the force of wind, or over pressure, and impact from water or other liquids and wind-borne debris by displacing the barrier out from and in front of the frangible area with inflatable cushions. The barrier is mounted on the building by attaching two opposing edges to anchors located so as to position the barrier as described. For example, one edge of the fabric can be anchored to the overhang of the roof or other high structure and the opposite edge of the span to the ground or low structure. The lower anchors can be attached to the foundation of the building or the ground by embedding in cement or other ground attachment such as tie downs or stakes and the like and providing grommets, rings or other attachments in the fabric to accept a clamp, cable, rope, and the like.

Another objective of this invention is to teach an inflatable structure placed between any opening in a structure and may be spaced from the structure a greater distance than the thickness of the cushion to allow for some deceleration before the cushion is compressed.

Still another objective of this invention is to teach the use of a retainer for deploying and securing the two opposing edges of a wind barrier material to retainer channels located so as to form a structure envelope about the openings with the barrier spanning the opening.

The curtain-like barrier of this invention is characterized as a barrier with strength and simplicity that is unattainable with the heretofore known barriers. Impact by a missile does not cause a large bang, and is not disturbing. It is easy to install, requires low maintenance and has low acquisition cost. There is much flexibility with storage. It can either be left in place or rolled much as a shade, or slid out of the way much as a curtain, so as not to interfere with the aesthetics of the building. It can also be fully removed and stored out of the way, or swung up to form a canopy when not in use as a protective barrier. It is preferable but not essential, that the material selected to be used in the netting fabric of this invention be inherently resistant to elements encountered in the outdoors or can be coated with coatings that afford resistance to these elements. The inflatable cushions can be separate from the netting or attached by interweaving, fasteners or pockets in the netting. The cushions may be stored with the netting or removed for storage elsewhere.

Another objective of this invention is to teach the use of valves in the inflatable cushions whereby they can be deflated for storage and inflated once the barrier is in place on the building.

Other objectives and advantages of this invention will become apparent from the following description taken in conjunction with the accompanying drawings wherein are set forth, by the way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

This barrier 10 is made up of a flexible material 11 that has known qualities of strength, stretch and deformation and is sufficiently strong to withstand applicable impact testing and one or more inflatable plenums or cushions 12. The barrier 10 does not derive its strength from stiffness or rigidity but rather from its bursting strength and stretch, with the latter acting like a spring to gradually decelerate any impacting missile. Wind speed may become a significant factor in larger spans.

Figure 1:
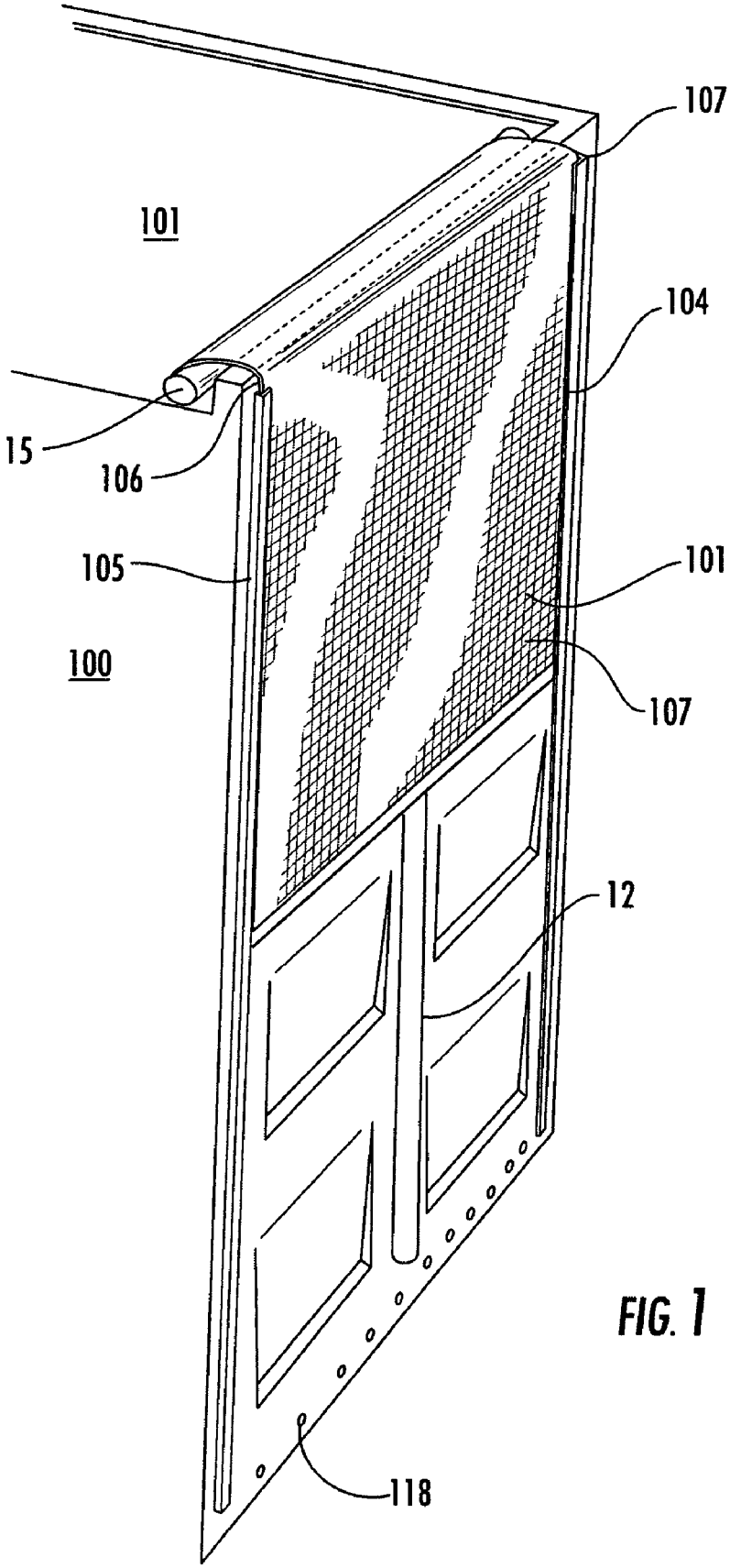
FIG. 1 is a partial view in perspective and schematic illustrating this invention partially deployed and attached to a building.
Figure 2:
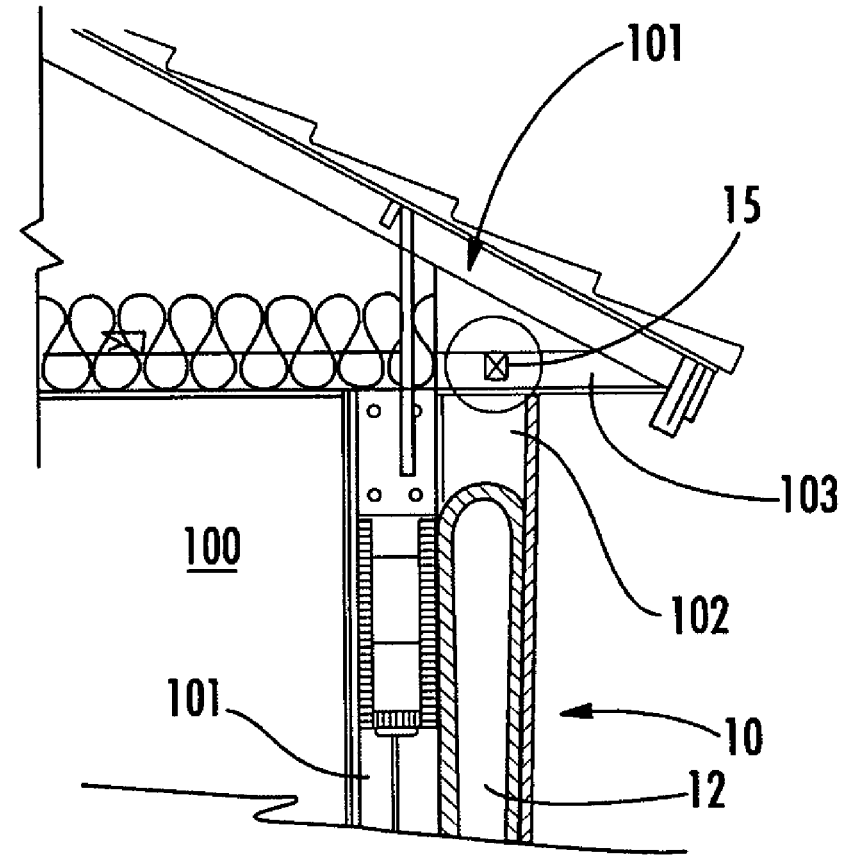
FIG. 2 is a partial cross section and side view illustrating the protective barrier and inflated cushion in place.
Figure 2:
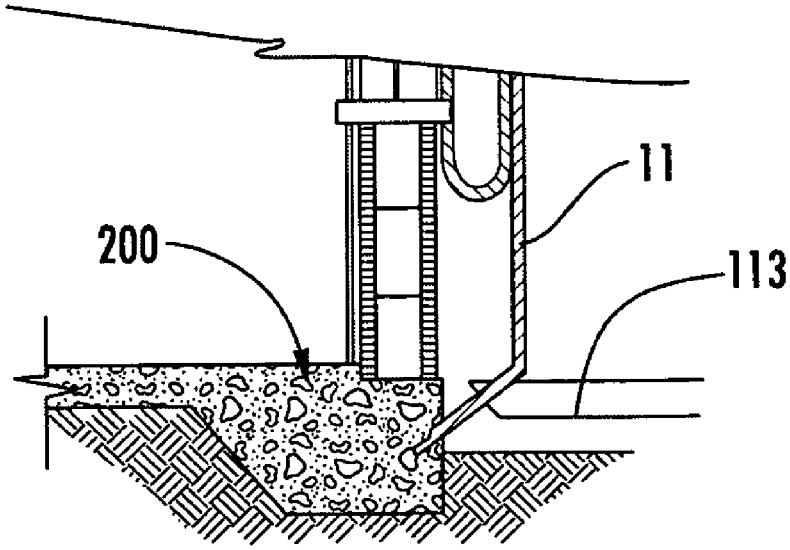
Figure 8:
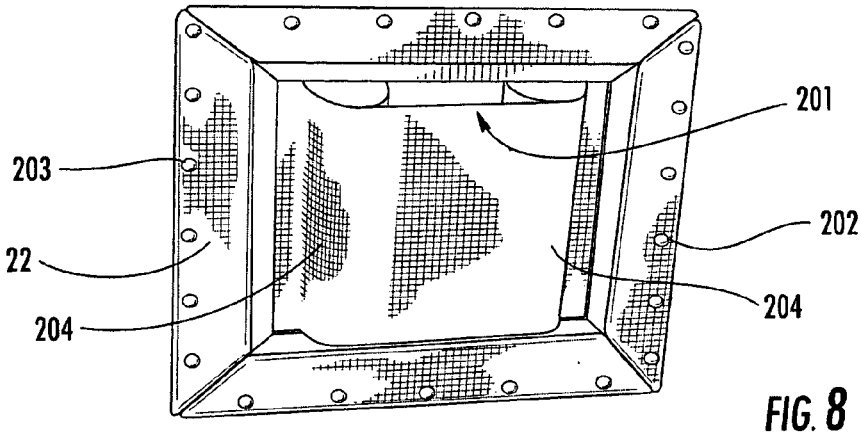
FIG. 8 is a perspective of a single window with an inflatable barrier in place.

There are many desirable characteristics of this barrier 10, such a resistance to weathering, light weight, ease of installation, deployment and storage, economy. Additionally, there are several methods of deploying and storing this barrier. While this invention is shown in its preferred embodiment as being utilized to protect the windows and overhang roof, shown in FIG. 2, of a structure, it is to be understood that this item has utility for other items requiring protection and is applicable to other types of structures, as shown in FIG. 8. Where appropriate, the barrier and inflatable plenums can be deployed horizontally, as well as, the vertical as shown in FIGS. 1-2.

Reference is now made to FIGS. 1-6 which partially show a building structure 100 including windows 110 intended to be protected from the onslaught of winds and debris typically occasioned during a hurricane. According to this invention the top of a curtain panel or material 11, made from a textile woven of a suitable fiber, (other weaves or knits may be used) is attached to roof 16 and the bottom thereof is attached to the foundation 200. A suitable material is polypropylene formed in a monofilament and woven into geotextile (style 20458)

manufactured by Synthetic Industries of Gainesville, Ga. The fabric is woven in a basket (plain) weave as in the preferred embodiment in interstices are substantially equal to 0.6 millimeters which approximates the interstices of commercially available residential window screening.

The selection of interstices size and configuration is dependent on the amount of transparency and air passage desired and the limitation that the maximum size must be sufficiently small to prevent objects that are potentially damaging on impact from passing there through. The above-mentioned regulations, set in place by Miami-Dade County, Florida, have determined that the smallest diameter missile (wind blown debris) with which they are concerned is 3/16 inch in diameter. Therefore to satisfy the Dade County Regulations the interstices must be small enough to prevent 3/16 inch diameter missiles from passing there through. Other regulations may set other minimum missile diameter sizes, and the interstice size would vary accordingly if new standards were to be met. The parameters of the test and the fabric are fully discussed in U.S. Pat. No. 6,176,050.

The cushions 12 have conventional inflation-deflation valves 116, such as those used in tires or sports equipment. The valves may include a safety valve which will open when a pre-selected internal pressure is exceeded. This will prevent rupture of the cushion. The inflation pressure of the cushions 12 can be adjusted to compensate for the impact pressure of the debris or test missile. A higher inflation pressure would decrease the amount of deflection of the material. In this manner, the improved barrier 10 would not require the spacing necessary with the material, per se. For example, a cushion having a depth of 2 feet may be used in spans from 8 feet to 40 feet and beyond. This permits attachment of the bottom of the barrier to the protected structure, as shown in FIG. 8, rather than being displaced away from the building.

Figure 6:
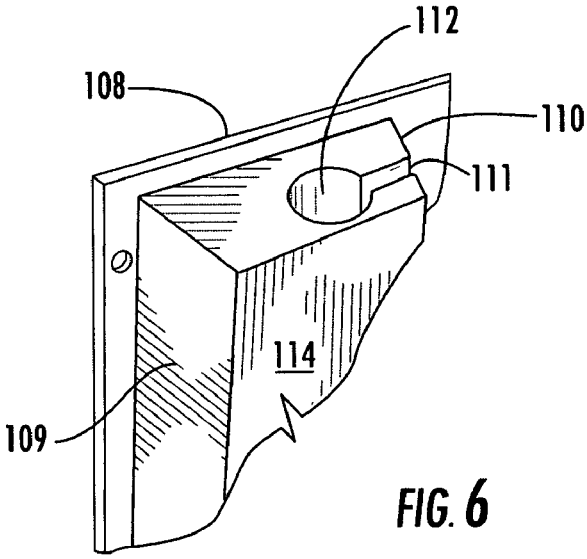
FIG. 6 is a diagrammatic and schematic view illustrating the channel.

The top of the barrier 10 is secured to the roof 101, facia 102, or under the eave 103. The bottom of the barrier would be secured to the foundation 200 of the building by fasteners 119. The longitudinal sides 13, 14 of the barrier are mounted in retainers 104, 105. The retainers 104, 105, as shown in FIG. 6, are elongated box-shaped metal sections permanently attached to the building. The retainers may be installed in sections or as a seamless whole. The top of the retainers 104, 105 have a flared opening 106, 107 to facilitate the feeding of the barrier 10 into the retainers as the barrier 10 is unrolled into position.

The base 108 of the retainers is bolted or otherwise fixed to the structure 100. The top wall 114 is parallel to the base. The outer wall 109 has a height that provides the spacing of the material 11 from the building 100 to permit the inflatable cushions to be deployed. The outer wall 109 of the opposite retainers 104, 105 enclose the longitudinal edges of the barrier to prevent wind entry between the barrier and the building. The inner wall 110 has a longitudinal groove 111 through which the longitudinal selvage edge of the material 11 slides. The groove 111 terminates in an enlarged channel 112 of a size and shape to permit the pins 113 to move.

Figure 4:
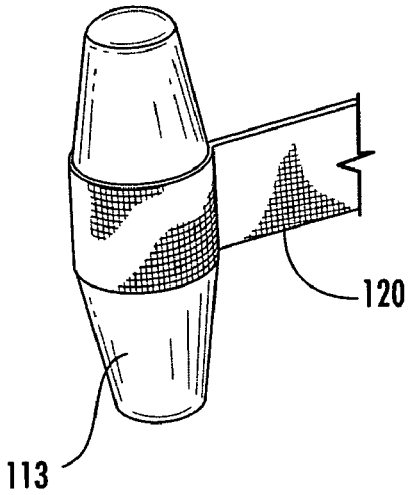
FIG. 4 is a detailed showing of a mechanism for attaching the retainers to the barrier.
Figure 5:
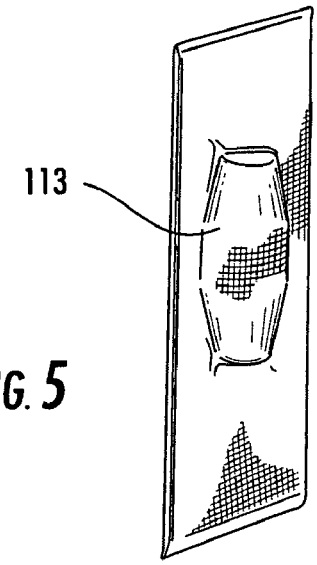
FIG. 5 is a detailed view of another mechanism for attaching the retainers to the barrier.

The pins 113, shown in FIGS. 4 and 5, are tapered from the central position toward each end. The pins may be attached to the longitudinal selvage by tabs 120 or hemmed into the selvage. As the barrier is deployed each pin enters the flared end of the retainers and slides down the channel. Since the slot is narrower than the diameter of the pins, the pins are captured in the channels. Other arrangements can include a cable attached to the longitudinal edges of the material.

Once the minimum space between the barrier and the structure being protected is established, the fabric must be anchored in a suitable manner so as to absorb the loads without being torn from its support. While various hardware devices may be used to anchor the fabric in place, general criteria include stainless steel bolts with 0.5 inch diameter and 1,000 lbs. max. bolt loading; 0.375 inch diameter and 625 lbs. max. bolt loading; with minimum pull-out force for steel 20× bolt loading; concrete 3,000 psi, spaced to achieve 1,100 lbs./linear foot; wood 2,400 lbs/linear inch of engaged thread; ground 8 inch helix ground anchor with 9,900 lbs. holding force in class 5 soil. These criteria are merely exemplary and not limiting. Other anchoring hardware may be used to install protective barrier of this invention.

As shown in FIGS. 1 and 2 the protective barrier 10 may be unrolled from a spindle 15 that is attached to the roof 101 or the eaves 103 of the roof by suitable threaded bolts or screws. The spindle attaching method allows for ease of installation as the installer can wrap the material around the spindle as necessary to adjust the material to the span and then attach the spindle to the building. Additionally, the use of a spindle 15 allows the edge if the barrier to be securely fastened overhead in a simple and economical method. Other methods are available in appropriate situations. The lower edge is fastened by anchors 118 set in recesses formed into the foundation to bury or partially bury eyebolts.

The material 11 may also be fabricated with a top and bottom selvage or hem or can utilize a reinforcing tape such as "Polytape" that is made from a polypropylene material. The selvage or tape may include commercially available grommets or rings to accept the tie-down hardware. The side margins may also have a selvage or other reinforcement with either grommets or ties for fastening to anchors placed in the wall of the structure.

Figure 3:
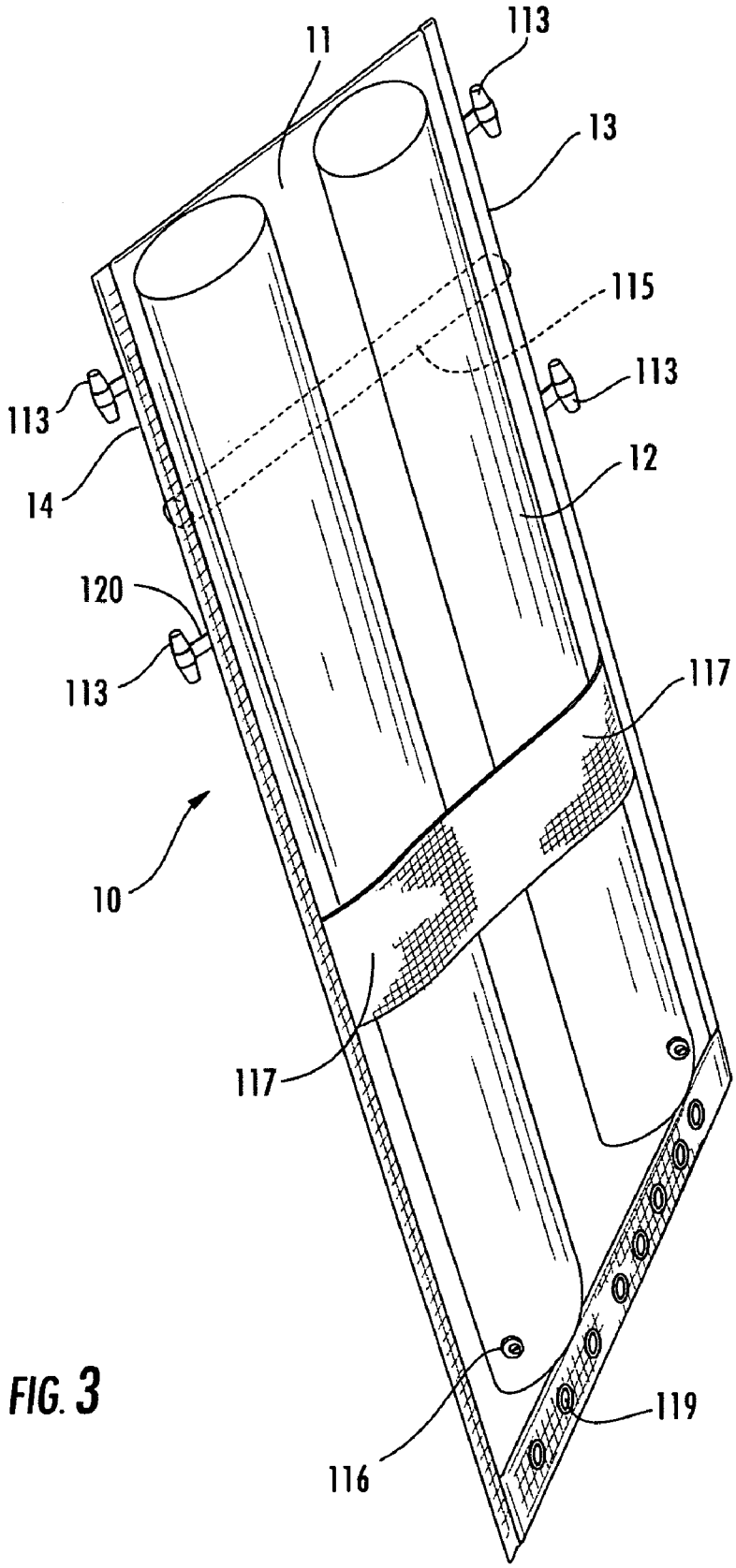
FIG. 3 is a perspective of the barrier showing holders for the cushions.
Figure 7:
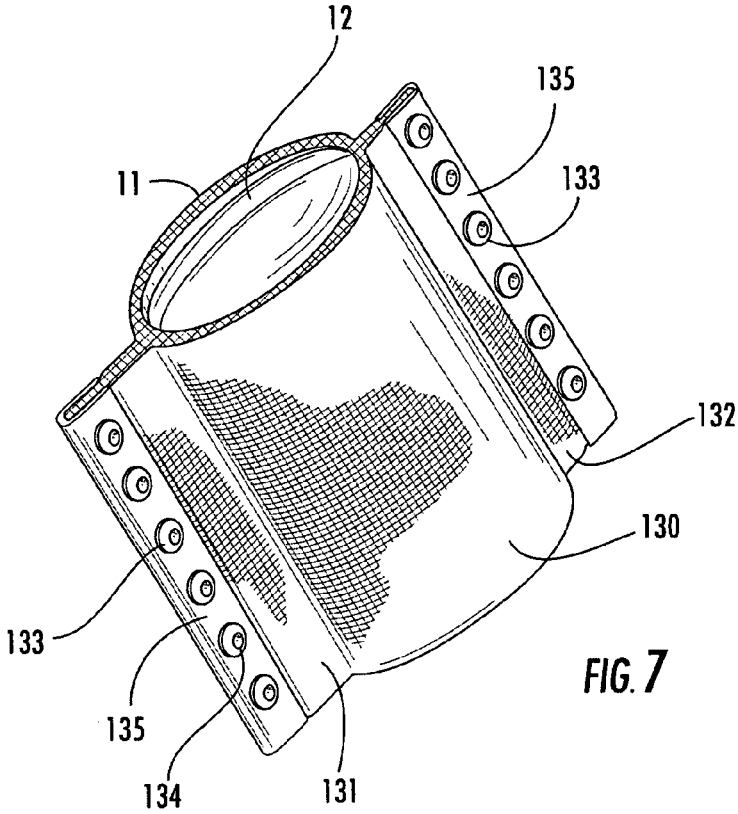
FIG. 7 is a perspective of a protective barrier for individual openings or small groups of openings.

The material, as shown in FIG. 3, may have one or more belts 117 for containing the cushions in alignment with the material 11. The belts may be of the same material or an elastic fabric. The belts 117 may be formed as loops with intermediate portions attached to the barrier by interweaving, adhesives or other fasteners. The loops would accommodate the width of the cushions. Alternatively or in addition, pockets may be fashioned in the top and bottom to enclose the ends of the cushions. The cushions or plenums may be completely surrounded by the fabric, as shown in FIG. 7.

The multiple story installation may be deployed simply by attaching the upper edge of the barrier to the bolts on the building and feeding the barrier into the top of the retainers then allowing the barrier to fall toward the ground. Once the lower edge becomes free, it can then be attached to a set of lower fasteners located at the corresponding vertical height on the building or the ground. The barrier can be winced down by a hand crank or motorized winch (not shown) attached by a line to the bottom selvage of the barrier. Thin metal, polymeric or wooden battens 115 may be placed across the width of the barrier at spaced intervals to control deployment evenly. Once the barrier is in place, the cushions 12 are inflated to the desired pressure. To store the barrier, the cushions are deflated and either removed or rolled up with the material 11.

The inflatable wind barrier may be deployed for individual openings such as windows and doors rather than covering major surfaces of a building, as shown in FIG. 8. FIG. 7 illustrates a plenum 12 encompassed by the material 11. The material 11 has flaps 131, 132 extending outwardly from the sleeve 130. Each flap terminates in a selvage 135, as shown. Grommets 133 are attached through the selvage 135 providing apertures 134 to connect to anchors along the periphery of the opening. Top and bottom flaps may also be provided. Other attachment devices, such as hooks, may be used in place of the grommets.

The cushions or plenums 12 may be inflated by pumps supplying high volume low pressure inflation, HVLP, for example home vacuum cleaners through a valve. The valve may include a means for sealing of the opening similar to a tire valve, inflatable dinghy valve, or conventional air cushion valve.

FIG. 8 illustrates a single frangible opening, such as a window 201, in a larger structure. The structure has a set of fasteners 202 mounted about the periphery of the window. Connected to these fasteners are the edges of the barrier material 11. The edges may have selvages and grommets 203 as mentioned above. Plenums 204 are located between the barrier and the window and are held in place by the fabric of the barrier. The plenums provide the spacing necessary for the fabric to decelerate debris, such as solids and liquids, before striking the frangible portion of the window. However, even if the frangible portion is broken, the barrier remains intact providing protection to the interior of the structure.

The inflatable cushion(s) permit adaptation of the barrier to meet the design of a particular enclosure or object. For instance, the inflatable cushion(s) may be placed directly over a window, preferably a wind rated window, to provide the necessary spacing of the fabric from the glass. Alternatively the inflatable cushion(s) may be placed over the mullions of a window thereby transferring wind loading directly to the inflatable cushion and thus to the structure of the mullion. Further, the inflatable cushion(s) may be placed along the edge of the window which is stronger than the center, or on the structure abutting window such as the frame or actual structure abutting the window. Similarly, the inflatable cushion(s) may be placed adjacent an object, such as a tiled wall, painting, statue, sculpture, or the like, to prevent wind, rain, and debris from impacting the object.

Although this invention has been shown and described with respect to detailed embodiments thereof, it will be appreciated and understood by those skilled in the art that various changes in form and detail thereof may be made without departing from the spirit and scope of the claimed invention.

I claim:

1. A flexible barrier system for protecting frangible portions of structures and objects from high winds, rain, and wind bourne debris, said flexible barrier comprising:

a spindle attachable to the structure;

a fabric material configured to withstand at least 1 inch Hg. over pressure, the fabric material being operable between a stored position in which the fabric material is wrapped onto the spindle and a deployed position in which the fabric material is unrolled from the spindle, wherein the spindle fastens an edge of the fabric material to the structure with strength suitable to protect the frangible portions of structures and objects from high winds, rain, and wind bourne debris; and at least one inflatable cushion configured to be deployed exclusively between a single planar surface of said fabric material and said frangible portion of a structure, wherein a combination of said fabric material and said at least one inflatable cushion is configured to a size and a shape to cover at least a portion of said frangible portion of a structure.

2. The flexible barrier of claim 1, wherein said fabric material comprises at least one sleeve comprising at least one central opening and opposed flaps extending therefrom and terminating in longitudinal edges, wherein each of said opposed flaps comprises at least one attachment device located in said longitudinal edges and is configured to connect to said structure, and wherein said at least one inflatable cushion is configured to be disposed in and surrounded by said device.

3. The flexible barrier of claim 1, wherein said at least one inflatable cushion is configured between said fabric material and said structure as a spacer between said fabric material and said structure.

4. The flexible barrier of claim 1, wherein said fabric material comprises a belt on one surface, and wherein said at least one inflatable cushion is configured between said fabric material and said belt.

5. The flexible barrier of claim 4, wherein said fabric material comprises a top and a bottom, an edge along said bottom, fasteners configured in said edge configured to attach said fabric material to said structure.

6. The flexible barrier of claim 5, wherein said fabric material further comprises opposite longitudinal sides connecting said top and said bottom, and a plurality of pins spaced along said opposite longitudinal sides, said plurality of pins configured to attach said fabric material to said structure.

7. The flexible barrier of claim 1, wherein said at least one inflatable cushion comprises a valve configured to introduce and/or remove a gas.

8. A hurricane shutter kit for installation on a structure, said kit comprising:

a spindle attachable to the structure;

a fabric material comprising a size and a shape to cover at least one opening of a structure, opposite longitudinal edges, and a connector configured to attach said longitudinal edges, the fabric material being operable between a stored position in which the fabric material is wrapped onto the spindle and a deployed position in which the fabric material is unrolled from the spindle, wherein the spindle fastens a horizontal edge of the fabric material to the structure with strength suitable to protect the frangible portions of structures and objects from high winds, rain, and wind bourne debris; and at least one inflatable cushion configured to be deployed exclusively between a single planar surface of said fabric material and said frangible portion of a structure, said at least one inflatable cushion comprising a size and a shape to span a portion of said at least one opening in said structure.

9. The hurricane shutter kit of claim 8, wherein said at least one inflatable cushion is configured centrally over said at least one structure opening.

10. The hurricane shutter kit of claim 8, wherein said at least one inflatable cushion is juxtapositioned along an edge of said at least one structure opening.

11. The hurricane shutter kit of claim 8, further comprising:

a retainer comprising a length commensurate with said fabric material, a channel comprising a size and a shape to capture said connector, and a base configured to permanently attach said retainer to said structure, wherein said at least one inflatable cushion is configured between said fabric material and said structure when said retainer is mounted on said structure and said connector is captured by said channel.

12. The hurricane shutter kit of claim 11, further comprising:

a second retainer similar to said retainer, said retainer and said second retainer configured to be spaced apart across a surface of said structure.

13. The hurricane shutter kit of claim 8, further comprising:

a valve for each of said at least one inflatable cushion, said valve configured to introduce and remove a gas from each of said at least one inflatable cushion.

* * * * *